US007053040B2

(12) United States Patent
Caruthers, Jr.

(10) Patent No.: US 7,053,040 B2
(45) Date of Patent: May 30, 2006

(54) AUTONOMOUS CLEANING COMPOSITION AND METHOD

(75) Inventor: Eddie L. Caruthers, Jr., Missouri City, TX (US)

(73) Assignee: Eco-Safe Technologies, L.L.C., South Jordan, UT (US)

( * ) Notice: Subject to any disclaimer, the term of this patent is extended or adjusted under 35 U.S.C. 154(b) by 174 days.

(21) Appl. No.: 10/775,264

(22) Filed: Feb. 10, 2004

(65) Prior Publication Data

US 2004/0162227 A1 Aug. 19, 2004

Related U.S. Application Data

(60) Continuation-in-part of application No. 10/144,331, filed on May 13, 2002, now Pat. No. 6,689,276, which is a division of application No. 09/437,532, filed on Nov. 10, 1999, now Pat. No. 6,403,551.

(60) Provisional application No. 60/448,239, filed on Feb. 18, 2003.

(51) Int. Cl.
*C11D 3/08* (2006.01)

(52) U.S. Cl. ..... 510/511; 510/507; 510/509; 510/446; 510/531

(58) Field of Classification Search ..... None
See application file for complete search history.

(56) References Cited

U.S. PATENT DOCUMENTS

| | | | | |
|---|---|---|---|---|
| 3,507,624 | A | 4/1970 | Schneider, Jr. et al. | |
| 3,640,876 | A | 2/1972 | Donaghu | |
| 3,715,314 | A | 2/1973 | Morgenstern | |
| 3,726,304 | A | 4/1973 | Cook | |
| 3,772,193 | A | 11/1973 | Nelli et al. | |
| 4,397,777 | A * | 8/1983 | Yurko | 510/324 |
| 5,118,439 | A | 6/1992 | Urfer et al. | |
| 5,316,692 | A | 5/1994 | John | |
| 5,338,528 | A * | 8/1994 | Sorensson et al. | 423/333 |
| 5,344,633 | A * | 9/1994 | Sorensson et al. | 423/333 |
| 5,443,751 | A * | 8/1995 | Mazzola | 510/349 |
| 5,650,017 | A | 7/1997 | Gordon et al. | |
| 5,665,694 | A | 9/1997 | Backes et al. | |
| 5,711,920 | A | 1/1998 | Barford et al. | |
| 5,755,330 | A | 5/1998 | Siragusa et al. | |
| 5,810,043 | A | 9/1998 | Grenier | |
| 5,827,434 | A | 10/1998 | Yando | |
| 5,870,906 | A | 2/1999 | Denisar | |
| 5,873,268 | A | 2/1999 | Spriggs et al. | |
| 5,916,866 | A * | 6/1999 | Davies et al. | 510/441 |
| 5,962,389 | A | 10/1999 | Partee et al. | |
| 6,063,747 | A | 5/2000 | Warwick | |
| 6,178,987 | B1 | 1/2001 | Caruthers, Jr. et al. | |
| 6,262,004 | B1 | 7/2001 | Caruthers, Jr. et al. | |
| 6,365,568 | B1 | 4/2002 | Olson et al. | |
| 6,387,864 | B1 * | 5/2002 | Bartelme | 510/336 |
| 6,403,551 | B1 | 6/2002 | Caruthers, Jr. et al. | |
| 6,689,276 | B1 | 2/2004 | Caruthers, Jr. | |

FOREIGN PATENT DOCUMENTS

| | | |
|---|---|---|
| GB | 2109398 | 6/1983 |
| WO | 91/17232 | 11/1991 |
| WO | 98/04672 | 2/1998 |

* cited by examiner

*Primary Examiner*—Gregory Webb
(74) *Attorney, Agent, or Firm*—Madson & Austin

(57) ABSTRACT

A solid cleaning composition and method of manufacture are disclosed, which provide a long-term, solid cartridge made of cleaning agents and a solubility limiting agent for controlling an equilibrium concentration of the composition in a solvent, such as water. In use, the cleaning agents are dissolved only to a predetermined concentration needed for a single dose of a cleaning appliance, such as a clothes washing machine. The solid cleaning composition may be cyclically exposed to water. Controlled dissolution of the cleaning composition releases a desired quantity of cleaning agents in each cleaning cycle. The use of potassium silicate as a solubility controlling compound permits manufacture of the cleaning composition at ambient temperatures and pressures. The cleaning composition may be molded or cast into a desirable shape for controlling surface area.

32 Claims, No Drawings

AUTONOMOUS CLEANING COMPOSITION AND METHOD

CROSS-REFERENCED RELATED APPLICATIONS

This application is a continuation-in-part of application Ser. No. 10/144,331, filed May 13, 2002, now U.S. Pat. No. 6,689,276 which is a division of application Ser. No. 09/437,532, filed Nov. 10, 1999, U.S. Pat. No. 6,403,551. This application claims the benefit of U.S. Provisional Application No. 60/448,239, filed Feb. 18, 2003, which applications are incorporated by reference.

BACKGROUND OF THE INVENTION

The present invention relates to cleaning systems, and more specifically, to compositions for cleaning with water, including slow release compositions for controlling concentrations of cleaning agents delivered into water.

Chemical cleaning agents, in one form or another, have long been used to remove dirt, oil, and particulate matter from a wide variety of articles. Cleaning improves the visual and tactile impression of an article, kills potentially harmful microbes, removes particles that interfere with breathing and vision, and may even extend the life of the article being cleaned. Things such as cookware, homes, automobiles, clothing, and the human body itself stand to benefit from the development of enhanced cleaning agents. Although the present invention contemplates cleaning systems useful for cleaning a wide variety of articles, it is particularly well-adapted for cleaning clothes, as in a washing machine.

Soaps and detergents are two of the most common cleaning agents presently used. While they are often used interchangeably, the words "soap" and "detergent" actually denote different classes of compounds.

Soaps are made by a process of saponification wherein a fatty acid reacts with a base to yield the salt of the fatty acid, i.e., a soap. Soap probably has its origin in reacting animal fats, or lard, with alkaline salts, such as wood ash. Today, they are largely synthesized from animal fats and plant oils. Molecules of soap owe their cleaning capacity to their amphiphilic structure, which includes a hydrophobic portion consisting of a long hydrocarbon chain, and a hydrophilic portion composed of an ionic group at one end of the hydrocarbon chain. Because of the hydrocarbon chain, a molecule of soap is not truly soluble in water. Numerous molecules of soap will suspend in water as micelles, or clusters of molecules with long hydrocarbon chains in the inner portions of the cluster, and ionic, water soluble ends facing the polar water.

Because these micelles form hydrophobic centers, they are able to dissolve other non-polar substances, like oils. Once the non-polar, oily dirt is dissolved within the micelles of soap, the ionic surfaces of the micelle repel each other, suspending the oil droplets and preventing them from coalescing. In this fashion, dirt and oil become trapped within the water soluble micelles, and wash away with the water.

A primary disadvantage of soaps is that they form insoluble salts (precipitates) with ions found in hard water. These salts, usually formed when $Ca^{++}$ and $Mg^{++}$ ions react with the carboxylate ends of soap molecules, precipitate out of solution as bathtub rings, grits, and other deposits. Water softeners that exchange $Ca^{++}$ and $Mg^{++}$ ions for more soluble $Na^{+}$ ions can alleviate most of this problem.

Most laundry products and many household cleansers actually contain detergents, not soaps. A detergent is a compound with a hydrophobic hydrocarbon chain plus a sulfonate or sulfate ionic end (whereas soaps have carboxylic ends). Because detergents also have an amphiphilic structure, they also form micelles and clean in the same fashion as soaps. However, detergents have the advantage that most metal alkylsulfonates and sulfates are water-soluble. Therefore, detergents do not precipitate out of solution with metal ions found in water. As a result, detergents are not inhibited by hard water. In addition, detergents can be synthesized with continuous chain alkyl groups, which are more easily broken down, or biodegraded, into smaller organic molecules by the microorganisms in septic tanks and sewage treatment plants.

A drawback of most detergents is that they contain additives that take much longer to biodegrade. Some components containing phosphates must be treated in plants. Phosphates therefore promote algae growth, chocking bodies of water and streams. Another disadvantage of detergents is that they can leave behind an undesirable residue even after thorough rinsing.

Detergents are currently used in many household appliances, such as dishwashers and washing machines. Presently, a user must measure out a dose of detergent to add to the cleaning appliance before every cleaning cycle. Conventional packaging and use of detergents creates messy clutter, consumes time, and typically results in a waste of detergent from overdosing. In addition, most washing machines for clothing use a separate rinsing cycle in order to remove the residue. Thus, additional time, water, and heat energy are required to complete the washing process.

It would be a great advancement in the art to provide a novel cleaning system that uses a novel non-detergent composition of cleaner that leaves no residue and therefore, requires no rinsing cycle. Another improvement in the art would be to provide a cleaning agent that is completely biodegradable. Still another improvement would be if this cleaning agent were made from natural materials. It would also be a great advancement in the art to provide a new method for making a non-detergent cleaning agent. It would be another advancement in the art to provide a cleaning agent that cleans better than the detergents presently on the market. Furthermore, it would be an improvement in the art to simplify the cleaning process and ameliorate the resultant mess with improved, preferably measurement-free or automatic, dosing over many cleaning cycles.

BRIEF SUMMARY OF THE INVENTION

In accordance with the invention as embodied and broadly described herein, a cleaning composition and method are disclosed in suitable detail to enable one of ordinary skill in the art to make and use the invention. In certain embodiments, an apparatus for dispensing cleaning agents in accordance with the present invention includes a vessel for containing a quantity of cleaning composition in solid form. The vessel preferably allows spent cleaning composition to be replaced with fresh composition. The cleaning composition in solid form preferably provides controlled dissolution in contact with water such that a given quantity of solid cleaning composition may be used to provide cleaning agent for multiple wash cycles of a cleaning appliance.

In one embodiment, the cartridge comprises a novel composition of cleaning agent for cleaning, and solubility control component for controlling the equilibrium concentration of the cleaning composition in solution, further described below, and the controlled dissolution of the solid composition. A water source supplies water to the vessel such that at least a portion of the water contacts the cleaning composition. Treated water is then conveyed to a cleaning appliance such as a brush, wand, dishwasher, or washing machine for clothing.

Various vessels for containing the solid cleaning composition, receiving water, and conveying treated water to a cleaning appliance are described in U.S. Pat. Nos. 6,178,987, 6,262,004, and 6,403,551, which patents are incorporated by reference.

Retrofit vessels for containing the solid cleaning composition may be utilized with the solid cleaning compositions within the scope of the present invention. Such retrofit vessels are designed to contain a replaceable quantity of the cleaning composition, to allow a quantity of water to contact the cleaning composition such that a controlled portion of the cleaning composition is dissolved in the water, and to allow the treated water to enter the cleaning appliance. The retrofit vessel does not need to be connected to the water feed lines of the cleaning appliance.

One typical retrofit vessel for use in a washing machine is designed to be located within the washing machine tub in a location where the water enters the tub. This may be just below the water spout. The vessel may be screened to facilitate water entering and draining the vessel. Typically only a portion of the feed water is diverted to flow into direct contact with the solid cleaning composition, and the remainder of the feed water flows directly into the tub, untreated. The exact amount of water that is diverted into contact with the cleaning composition may range from about 10% to 50% by volume, and more preferably, from 20% to 40% by volume of water. The apparatus may include movable structures for controlling the quantity of water that is diverted into contact with the cleaning resin. A door is provided to allow spent cleaning composition to be removed and replaced with fresh cleaning composition.

Enough cleaning solution should be delivered to the feed, to bring the cleaning composition to cleaning concentration when diluted in the washing appliance. Cleaning concentration is the amount of cleaning composition necessary to clean those items serviced by (e.g. placed within) the cleaning appliance during a wash cycle. In particular, a cleaning concentration for a washing machine is that concentration needed to clean a load of clothing. The amount of cleaning composition delivered to the feed is controlled by the amount of cleaning solution and the cleaning solution's equilibrium concentration. Therefore, the vessel should be configured to receive a predetermined amount of solution, and the solubility control in the cartridge should be configured to dissolve a predetermined equilibrium concentration of cleaning composition in the vessel.

As explained, a composition of cleaner in accordance with the present invention may include a mixture of a cleaning agent and a solubility control agent in a solid state. The composition may also comprise an additional alkalinity agent and a water softener. The principal cleaning agent is preferably a gas-releasing compound, such as sodium bicarbonate, sodium carbon, sodium percarbonate, sodium perborate monohydrate, sodium perborate tetrahydrate, and mixtures thereof. Gas-releasing compounds clean by reacting with acids (soils) and by mechanical microscrubbing as they yield carbon dioxide.

The solubility control agent is preferably a material resistant to dissolving in water after a designated curing time, such as potassium silicate. These compounds control solubility by dissolving only an allocated equilibrium concentration of composition in solution. The solubility control agent is preferably a material resistant to dissolving in water, i.e., water insoluble or slightly water-soluble. Such compounds control solubility by dissolving only an equilibrium concentration of composition in solution. Numerous compounds may serve this function, including but not limited to hydrophobic compounds. Those solubility control agents that are both found in nature and biodegradable are preferred.

The alkalinity agent is preferably a basic compound found in nature, such as sodium carbonate or sodium sesquicarbonate (which actually contains sodium bicarbonate and sodium carbonate in a substantially 1:1 ratio). It will be appreciated that some ingredients, such as sodium carbonate may function as both an alkalinity agent and as a gas-releasing agent. The alkalinity agent prevents the cleaning agent from releasing carbon dioxide too quickly by increasing the pH of the solution. The water softener is preferably a naturally occurring material capable of solvating hard water ions, such as a zeolite. Naturally occurring zeolites are presently preferred; however, the invention may be used with synthetic zeolites which function in a manner equivalent to natural zeolites and which biodegrade. The water softener solvates hard ions and inhibits them from reacting with other components to form insoluble salts.

The composition of cleaner may be formulated and cured into various solid shapes. One presently preferred shape is a cylindrical cartridge with an annular cross section. The annular shaped cylinder provides a useful advantage in that, as it dissolves, it retains approximately the same surface area, and hence approximately the same dissolution rate. This is because the annular shape yields an interior surface that increases in area at approximately the same rate that the exterior surface decreases in area. Other solid shapes having a hollow interior surface may be used to provide an approximately constant dissolution rate. Such solid shapes may include, but are not limited to, oblong, oval or egg-shaped cylindrical cartridges with an annular, or similar shaped, hollow cross section and polygonal (triangular, rectangular, pentagonal, hexagonal, etc.) prisms with hollow polygonal cross sections.

The amount of solubility control component in the composition determines the equilibrium concentration of the composition in a solution, e.g., water. Therefore, the amount of solubility control component should be sufficient to yield a predetermined equilibrium concentration of composition. Similarly, the amount of cleaning agent should be sufficient to provide a predetermined amount of gas in solution. The amount of alkalinity agent should be sufficient to provide a predetermined pH in solution. The amount of water softener should be sufficient to soften household water in solution.

U.S. Pat. Nos. 6,178,987, 6,262,004, and 6,403,551 disclose a solid cleaning composition containing amorphous silica as the solubility control agent. Amorphous silica ($H_2SiO_3$) is a preferred solubility control agent because it occurs in nature and is completely biodegradable. In the cleaning compositions containing amorphous silica disclosed in the above-identified patents, careful heating and pressurizing is needed to prepare the cleaning compositions. It has been found that commercially available potassium silicate ($K_2O._nSiO_2.mH_2O$), in liquid form, may be used to prepare the cleaning compositions at room temperature without special heating or pressure. The other ingredients at approximately the same concentration may be used. Completion of the process may include casting or molding the composition in a shape selected to control surface area, and curing the composition. The composition cures independently at room temperature as water becomes depleted through evaporation and/or as a result of the anhydrous compounds absorbing water.

In certain embodiments within the scope of the present invention, the method of preparing the cleaning composition may include providing a solvent, such as water; providing a gas-releasing agent, such as sodium bicarbonate, sodium carbon, sodium percarbonate, sodium perborate monohydrate, sodium tetrahydrate, and mixtures thereof; providing a water softener, such as a zeolite; providing a solubility control agent, such as potassium silicate; mixing the ingredients; pouring the mixture into a curing vessel; and allowing the composition to cure to a solid form.

These and other features, and advantages of the present invention will become more fully apparent from the following description and appended claims, or may be learned by the practice of the invention as set forth hereinafter.

DETAILED DESCRIPTION OF THE INVENTION

The present invention is drawn to solid cleaning compositions, methods of manufacture and use. The cleaning composition in solid form preferably provides controlled dissolution in contact with water such that a given quantity of cleaning composition may provide sufficient cleaning agent for multiple wash cycles of a cleaning appliance.

The cleaning composition may include a gas-releasing agent that is water soluble, and a solubility control agent that is only slightly water soluble. The gas-releasing agent provides cleaning action. However, if the gas-releasing agent is permitted to freely dissolve, the resulting cleaning solution will have an unknown or uncontrolled concentration of gas-releasing agent. Thus, it is desirable to add a solubility control agent to the cleaning composition to control its equilibrium concentration, and hence, the concentration of gas-releasing agent in the cleaning solution.

The cleaning composition may be further enhanced through the addition of an alkalinity agent and a water softener. The alkalinity agent controls the pH of the cleaning composition, and therefore the pH of the resultant cleaning solution. The pH of the cleaning solution should remain within a certain range because the pH controls the rate at which the gas-releasing agent reacts. The gas-releasing agent or the solubility control agent may be configured to control the pH of the cleaning solution, but a separate alkalinity agent is presently preferred. The softener prevents the formation of a residue on the items to be cleaned by solvating hard water ions. The gas-releasing agent, the solubility control agent, or the alkalinity agent may be configured to solvate hard water ions, but a separate softener is preferable.

The gas-releasing agent should not release gas in the solid state cleaning composition, but it should be able to release gas in a cleaning solution of the cleaning composition at ambient temperature. The gas-releasing agent need not react with other agents, but may simply decompose at ambient temperature to release gas. Those gas-releasing compounds that are natural and biodegradable are preferred. In some embodiments, the gas-releasing agent is a carbonate, bicarbonate, or percarbonate. For example, sodium percarbonate, which is also known as sodium carbonate peroxyhydrate, ($2Na_2CO_3.3H_2O_2$), sodium bicarbonate, ($NaHCO_3$), sodium perborate monohydrate ($NaBO_3.H_2O$), sodium perborate tetrahydrate ($NaBO_3.4H_2O$), and sodium carbonate ($Na_2CO_3$) are effective, low cost gas-releasing agents. Mixtures of gas releasing agents may be used. However, numerous other gas-releasing agents are known to those skilled in the art, and all are within the scope of the present invention. Sodium percarbonate is a presently preferred gas releasing agent.

The solubility control agent should be either water insoluble or only slightly water soluble. Numerous compounds may serve this function, including but not limited to hydrophobic compounds. Those solubility control agents that are both found in nature and biodegradable are preferred. Potassium silicate is presently preferred because it may be used to prepare the solid cleaning compositions at room temperature.

The alkalinity agent may be selected from, but is not limited to, a group consisting of alkali hydroxide, alkali hydride, alkali oxide, alkali carbonate, alkali bicarbonate, alkali phosphate, alkali borate, alkali salt of mineral acid, alkali amine, alkaloid, alkali cyanide, alkali metal, and alkali earth metal. Other alkalinity agents that tend to increase the pH of a neutral solution are familiar to those in the art, and are within the scope of the present invention. Those alkalinity agents that are both found in nature and biodegradable are preferred. Sodium carbonate provides the dual function of an alkalinity agent and a gas releasing agent. Similarly, sodium percarbonate provides alkalinity control in addition to its gas release function.

The softener should preferably be selected to exchange soluble sodium or other ions for the insoluble calcium and magnesium ions. Those softeners that are both found in nature and biodegradable are preferred. A cleaning composition wherein the softener is natural zeolite ($Na_2O.Al_2O_3.(SiO_2)_x.(H_2O)_x$) is presently preferred because it occurs in nature and is completely biodegradable. Of course, synthetic zeolites may be used provided that they perform the desired softening function and are biodegradable.

Because the cleaning composition is intended to be dissolved in an apparatus for delivering solvated cleaning agents at a particular concentration to a cleaning appliance, the amount of each component of the cleaning composition is preferably tailored to provide a desired equilibrium concentration and dissolution rate.

The amount of gas-releasing agent in the cleaning composition determines how much gas is released in a cleaning solution of the cleaning composition formed when the cleaning composition dissolves in a solvent, e.g., water. Therefore, the gas-releasing agent in the cleaning composition should comprise an amount sufficient to release a predetermined amount of gas in a cleaning solution of the cleaning composition. A concentration of gas-releasing agent from 20% to 60% by weight of the cleaning composition is preferred. In one embodiment, the concentration of gas-releasing agent is from 35% to 45% by weight.

The amount of solubility control agent in the cleaning composition determines the equilibrium concentration of the cleaning composition in the cleaning solution. Therefore, the amount of solubility control agent in the cleaning composition should be selected to yield a predetermined equilibrium concentration of cleaning composition in the cleaning solution. A concentration of solubility control agent from 5% to 35% by weight of the cleaning composition is presently preferred. In one embodiment, the concentration of solubility control agent is about 30% by weight to yield an equilibrium concentration of the cleaning composition that is approximately 0.12% by weight in water.

The amount of alkalinity agent in the cleaning composition affects the pH of the cleaning solution. Therefore, the cleaning composition should include an amount of alkalinity agent selected to provide a cleaning solution with a predetermined pH. A concentration of alkalinity agent from 1% to 35% by weight of the cleaning composition is presently preferred. Because the alkalinity agent may also provide gas releasing functionality, in the case of sodium carbonate, the actual concentration of the gas releasing agent and alkalinity agent may be outside the foregoing concentration range. In one embodiment, the concentration of alkalinity agent is about 3% by weight, providing a cleaning solution with a pH of about 8.8 after dilution inside the cleaning appliance.

The softener in the cleaning composition softens the cleaning solution by scavenging residue-forming ions. Therefore, the softener should comprise an amount of cleaning composition sufficient to soften household water. A concentration of softener from 1% to 20% by weight of the cleaning composition is presently preferred. In one embodiment, the concentration of the softener is about 8% by weight.

Water molecules may form complexes with these components and could be bound up within the cleaning composition by virtue of the process of making the cleaning composition. Water may comprise from 1% to 50% of the cleaning composition by weight. Preferably, water comprises approximately 20% by weight of the cleaning composition. It will be appreciated that some components of the cleaning composition may contain water, such as potassium silicate, which may limit the amount of extra water that needs to be mixed with the dry ingredients.

In operation, items to be cleaned are exposed to the cleaning solution, which causes a number of processes occur. The basic cleaning solution attacks the acids in dirt and oil. In a first reaction step, the gas-releasing agent reacts with dirt and oil. In a gas-releasing step, gas is released. In a cleaning appliance for washing clothing, dirt and oil would be dislodged from clothing in a removal step due to reaction and the sudden release of gas. In a second reaction step, the gas-releasing agent continues to react with removed soils.

Simultaneously, in a scavenging step, the softener scavenges ions to prevent the buildup of residue on the articles to be cleaned. In addition, the alkalinity agent keeps the pH of the cleaning solution slightly basic. This serves two functions. First of all, it bridles the reaction of the gas-releasing agent so that the gas evolves at a controlled rate and the cleaning solution has time to become thoroughly intermixed with the articles to be cleaned. Second, the basic cleaning solution reacts to neutralize acids in the soils.

An exemplary cleaning process utilizing an exemplary cleaning composition will now be described. First, the sodium percarbonate and sodium carbonate attack acids within the dirt and oils. The acid-base reactions have an emulsifying affect on the dirt and oils. Particularly, sodium percarbonate (which includes sodium carbonate) reacts with acids to generate carbon dioxide in an acid and base reaction: $2H^+(aq)+Na_2CO_3(aq)\rightarrow 2Na^+(aq)+H_2O+CO_2(g)$. Most oils and dirts found in clothing are slightly acidic, and so the sodium carbonate component of the percarbonate may react with these dirts and oils to produce carbon dioxide. This tiny explosion of gas, as it bubbles out of solution, dislodges the dirt from clothes and other materials, allowing it to be washed away. The reaction yields sodium ions in solution, or the sodium salts of the oils and dirts of the reaction, water and carbon dioxide.

In this embodiment, the byproducts of the cleaning process appear in nature, so there is no need for the extensive treatment of phosphates and other non-biodegradable materials, as required by presently available detergents. However, the alkalinity agent, which may include sodium carbonate, is added primarily to increase the pH of the cleaning solution but also functions as a gas releasing agent, described above. In a similar manner, sodium percarbonate, is added primarily as a gas releasing agent but also increases the pH of the cleaning solution as an alkalinity agent.

The alkalinity agent provides a mildly basic solution to prevent the sodium percarbonate from reacting with excess hydrogen ions ($H^+$) in aqueous solution. Without the alkalinity agent, $CO_2$ would bubble out of solution too quickly as the sodium percarbonate reacts with random hydrogen ions. With a slightly alkaline cleaning solution, in one embodiment approximately 8.8 pH, the sodium percarbonate reacts at a controlled pace, and preferably with the acids in the dirts and oils.

The softener, which may be natural zeolite, exchanges sodium ions ($Na^+$) for magnesium ($Mg^{++}$) and calcium ($Ca^{++}$) ions: $Mg^{++}+Ca^{++}+\text{zeolite}\rightarrow\text{zeolite}+4Na^+$. Sodium ions and sodium salts are readily water soluble and will not form precipitates. Without the softener, the $Mg^{++}$ and $Ca^{++}$ could react to form insoluble salts, precipitating out of solution and leaving a hard film behind, as shown by the following equations: $NaHCO_3+Mg^{++}\rightarrow MgCO_3$, and $NaHCO_3+Ca^{++}\rightarrow CaCO_3$.

One possible method for making the cleaning composition in a solid state will be described. In the described method a solvent, a gas releasing agent, a solubility control agent, an alkalinity agent, and a softener, are combined to form the cleaning composition. It will be appreciated that the cleaning composition may be manufactured with some components performing multiple functions or with additional, unnamed agents.

The solvent may be included with the solubility control agent, if in liquid form. The solvent will typically be water, and may comprise form 1% to 50% by weight of the cleaning composition. The concentration of the other foregoing ingredients may be generally identified as follows: gas-releasing agent, 20% to 60% by weight of the cleaning composition; water softener, 1% to 20% by weight of the cleaning composition; solubility control agent, 5% to 35% by weight of the cleaning composition; and alkalinity agent, 1% to 35% by weight of the cleaning composition. More preferably, the concentration of the foregoing ingredients may be generally identified as follows: gas-releasing agent, 30% to 45% by weight of the cleaning composition; water softener, 5% to 15% by weight of the cleaning composition; solubility control agent, 20% to 35% by weight of the cleaning composition; and alkalinity agent, 20% to 35% by weight of the cleaning composition.

One cleaning composition within the scope of the invention has the following ingredients set forth in Table 1:

TABLE 1

| Ingredient | Weight Percent |
|---|---|
| Water | 29% |
| Sodium Bicarbonate | 39% |
| Natural Zeolite | 8% |
| Potassium silicate | 21% |
| Sodium Sesquicarbonate | 3% |

Another cleaning composition within the scope of the present invention has the following ingredients set forth in Table 2:

TABLE 2

| Ingredient | Weight Percent |
|---|---|
| Sodium Perborate Monohydrate | 37.0% |
| Sodium Carbonate | 31.2% |
| Natural Zeolite | 8% |
| Optical Brightener | 1.0% |
| Potassium silicate | 22.8% |

With the formula of Table 2, ingredients were added as listed. The powders (first four items) were combined and mixed prior to adding liquid potassium silicate. After adding the potassium silicate, the product was mixed briefly and poured into a mold. Set-up and hardening began within ten minutes after the addition of the potassium silicate at room temperature.

The optical brightener is an additive that improves visual appearance in cleaned fabrics. An optical brightener may be added to the cleaning composition in an amount from about 1% to 3% by weight. The sodium perborate monohydrate and the sodium carbonate both release gas. The carbonate releases carbon dioxide and the perborate releases oxygen. The potassium silicate provides some solubility control. The sodium carbonate serves a dual role as gas releaser and alkalinity agent.

It has been found that potassium silicate may be used successfully, while sodium silicate may not be used to prepare the cleaning composition. While not being bound by theory, it is believed that potassium silicate is operative because it does not raise the pH too high. Potassium silicate has a pH of about 11, whereas sodium silicate has a pH of about 13. With this information, it may be possible to include a suitable pH modifier with sodium silicate to successfully prepare the cleaning composition.

Yet another cleaning composition within the scope of the present invention has the following ingredients set forth in Table 3:

TABLE 3

| Ingredient | Weight Percent |
|---|---|
| Sodium Percarbonate | 38% |
| Sodium Carbonate | 25% |
| Carboxymethylcellulose | 1% |
| Natural Zeolite | 8% |
| Potassium silicate | 28% |

With the formula of Table 3, ingredients were added as listed. The powders (first four items) were combined and slowly mixed to minimize dusting, but mixed brisk enough to ensure total dispersion. The liquid potassium silicate was added slowing with the mixer running. As the product thickens, a small amount of base (sodium hydroxide, less than 0.5 weight percent) was added to aid in processing by thinning the material and allowing a longer mix time. After about 5 to 10 minutes, the product started to stiffen, and it was poured into a mold for curing. Set-up and hardening began within ten minutes after the addition of the potassium silicate at room temperature.

The carboxymethylcellulose is a soil anti-redeposition compound. The sodium percarbonate and the sodium carbonate both release gas. The carbonate releases carbon dioxide and the percarbonate releases oxygen. The potassium silicate provides some solubility control. The sodium carbonate serves a dual role as gas releaser and alkalinity agent. The amounts listed in Table 3 can be varied by a few weight percent.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A cleaning composition in a solid state comprising:

a gas-releasing component as a cleaning agent selected from the group consisting of perborates, percarbonates, and mixtures thereof, wherein the gas-releasing component is present in an amount from 20% to 60% by weight;

potassium silicate as a solubility control component to limit the solubility of the cleaning composition, wherein the potassium silicate is present in an amount of at least 20% by weight;

an alkalinity agent as a pH regulator, wherein the alkalinity agent is present in an amount from 1% to 35% by weight; and a water softener to solvate metal ions in a solution of water, wherein the water softener is present in an amount from 1% to 20% by weight.

2. The composition of claim 1, wherein the water softener is selected from the group consisting of ion exchange particles and salts of weak acids.

3. The composition of claim 1, wherein the water softener is natural zeolite.

4. The composition of claim 1, wherein the water softener is synthetic zeolite.

5. The composition in claim 1, wherein the gas-releasing component is sodium percarbonate.

6. The composition in claim 1, wherein the gas-releasing component is sodium perborate monohydrate.

7. The composition in claim 1, wherein the gas-releasing component is present in an amount sufficient to release an effective amount of gas after the composition reaches an equilibrium concentration in a vessel, and the equilibrium concentration is diluted in a cleaning appliance.

8. The composition in claim 7, wherein the effective amount of gas generated is from about 5% to about 9.5% by volume with respect to the volume of water.

9. The composition of claim 1, wherein the alkalinity agent is selected from the group consisting of an alkali hydroxide, alkali hydride, alkali oxide, alkali phosphate, alkali borate, alkali salt of mineral acid, alkali amine, alkaloid, and alkali cyanide.

10. The composition of claim 1, wherein the alkalinity agent is sodium hydroxide.

11. The composition of claim 1, wherein the alkalinity agent is present in an amount sufficient to give a solution of the composition a pH greater than 7.

12. The composition of claim 1, wherein the alkalinity agent is present in an amount sufficient to give a solution of the composition a pH from about 7.8 to about 8.8.

13. The composition of claim 1, further comprising an anti-redeposition component present in an amount from about 1% to 3% by weight.

14. The composition of claim 1, wherein the cleaning composition is in a solid form having a surface area configuration designed to provide approximately constant surface area as the cleaning composition dissolves.

15. A cleaning composition in a solid state comprising:

a gas-releasing component as a cleaning agent selected which is sodium perborate monohydrate;

a solubility control component which is potassium silicate to limit the solubility of the cleaning composition, wherein the solubility control component is present in an amount of at least 20% by weight;

an alkalinity agent as a pH regulator which is an alkali hydroxide; and a zeolite water softener to solvate metal ions in a solution of water.

16. The composition of claim 15, wherein the gas-releasing component is present in an amount from 20% to 60% by weight.

17. The composition of claim 15, wherein the water softener is present in an amount from 1% to 20% by weight.

18. The composition of claim 15, wherein the gas-releasing component is present in an amount from 30% to 45% by weight, wherein the solubility control component is present in an amount from 20% to 35% by weight, wherein the water softener is present in an amount from 5% to 15% by weight, and wherein the alkalinity agent is present in an amount from 20% to 35% by weight.

19. The composition of claim 15, wherein the alkalinity agent is present in an amount sufficient to give a solution of the composition a pH greater than 7.

20. The composition of claim 15, wherein the alkalinity agent is present in an amount sufficient to give a solution of the composition a pH from about 7.8 to about 8.8.

21. The composition of claim 15, further comprising an anti-redeposition component present in an amount from about 1% to 3% by weight.

22. The composition of claim 15, wherein the cleaning composition is in a solid form having a surface area configuration designed to provide approximately constant surface area as the cleaning composition dissolves.

23. A method of making a cleaning composition in solid state comprising the steps of:

mixing a gas releasing component, an optical brightener, an anti-redeposition component, and a water softener to form a dry mixture;

adding liquid potassium silicate while continuing to mix the dry mixture;

adding a base, as a processing aid;

pouring the mixture into a mold; and curing the cleaning composition.

24. The method of claim 23, wherein the quantity of base is less than 1% by weight of the cleaning composition.

25. The method of claim 23, wherein the gas releasing component is sodium.

26. The method of claim 23, wherein the base is an alkali hydroxide.

27. The method of claim 23, wherein the water softener is a synthetic zeolite.

28. The method of claim 23, wherein the anti-redeposition component is present in an amount from about 1% to 3% by weight of the cleaning composition.

29. The method of claim 23, wherein the gas releasing component is sodium perborate monohydrate, the base is an alkali hydroxide, and the water softener is a synthetic zeolite.

30. The method of claim 29, wherein the gas releasing component is present in an amount of about 20% to 60% by weight of the cleaning composition, wherein the alkalinity agent is present in an amount of about 1% to 35% by weight of the cleaning composition, wherein the water softener is present in an amount from about 1% to 20% by weight of the cleaning composition.

31. The method of claim 30, wherein the anti-redeposition component is carboxymethylcellulose present in an amount from about 1% to 3% by weight of the cleaning composition.

32. The method of claim 23, wherein the mold is configured to form a solid cleaning composition having a surface area configuration designed to provide approximately constant surface area as the cleaning composition dissolves.

* * * * *